US006915847B2

(12) United States Patent
Brockman

(10) Patent No.: US 6,915,847 B2
(45) Date of Patent: Jul. 12, 2005

(54) TESTING A JUNCTION OF PLURAL BORES IN A WELL

(75) Inventor: Mark W. Brockman, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 169 days.

(21) Appl. No.: 10/368,064

(22) Filed: Feb. 14, 2003

(65) Prior Publication Data

US 2004/0159429 A1 Aug. 19, 2004

(51) Int. Cl.[7] ..... E21B 47/10
(52) U.S. Cl. ..... 166/250.08; 166/337; 166/50
(58) Field of Search ..... 166/337, 250.08, 166/250.07, 250.01, 336, 313, 50

(56) References Cited

U.S. PATENT DOCUMENTS

| | | | | |
|---|---|---|---|---|
| 4,415,205 | A | | 11/1983 | Rehm et al. |
| 4,573,541 | A | | 3/1986 | Josse et al. |
| 5,052,482 | A | * | 10/1991 | Gondouin ..... 166/50 |
| 5,172,112 | A | * | 12/1992 | Jennings ..... 340/850 |
| 5,301,760 | A | | 4/1994 | Graham |
| 5,311,936 | A | | 5/1994 | McNair et al. |
| 5,325,924 | A | | 7/1994 | Bangert et al. |
| 5,330,007 | A | | 7/1994 | Collins et al. |
| 5,337,808 | A | | 8/1994 | Graham |
| 5,388,648 | A | | 2/1995 | Jordan, Jr. |
| 5,398,754 | A | | 3/1995 | Dinhoble |
| 5,457,988 | A | | 10/1995 | Delatorre |
| 5,458,209 | A | | 10/1995 | Hayes et al. |
| 5,462,120 | A | | 10/1995 | Gondouin |
| 5,472,048 | A | | 12/1995 | Kennedy et al. |
| 5,474,131 | A | | 12/1995 | Jordan, Jr. et al. |
| 5,477,925 | A | | 12/1995 | Trahan et al. |
| 5,655,602 | A | | 8/1997 | Collins |
| 5,680,901 | A | | 10/1997 | Gardes |
| 5,697,445 | A | | 12/1997 | Graham |
| 5,823,263 | A | | 10/1998 | Morris et al. |
| 5,941,308 | A | | 8/1999 | Malone et al. |
| 5,944,108 | A | | 8/1999 | Baugh et al. |
| 5,944,109 | A | | 8/1999 | Longbottom |

(Continued)

FOREIGN PATENT DOCUMENTS

| | | |
|---|---|---|
| EP | 0786578 A2 | 7/1997 |
| GB | 2304764 A | 3/1997 |
| GB | 2333545 A | 7/1999 |
| WO | WO96/23953 | 8/1996 |
| WO | WO99/13195 | 3/1999 |
| WO | WO00/29713 | 5/2000 |

OTHER PUBLICATIONS

SPE Paper No. 38268 "Analyzing a Multi–Lateral Well Failure in the East Wilmington Field of California", A. Ray Brister, Author, dated Jun. 25–27, 1997.

*Primary Examiner*—David Bagnell
*Assistant Examiner*—Daniel P Stephenson
(74) *Attorney, Agent, or Firm*—Trop, Pruner & Nu PC; Jamie Castaño; Dale Gavdier

(57) ABSTRACT

A test technique and mechanism includes lowering a junction assembly to a junction between at least two bores of a well. The junction assembly includes one or more sealed connections that are tested by the generation of a test flow of fluid. The distal ends of the junction assembly are blocked so that a pressure increase in the junction assembly can be monitored. The level of this pressure increase is used to determine if there is any leakage in the junction assembly. To reduce the costs associated with a faulty junction assembly, the testing is performed during an installation procedure of the junction assembly. Thus, if a faulty junction is detected, it can be quickly removed and replaced with another junction assembly.

16 Claims, 12 Drawing Sheets

U.S. PATENT DOCUMENTS

| | | | | |
|---|---|---|---|---|
| 5,960,873 | A | | 10/1999 | Alexander et al. |
| 6,035,937 | A | | 3/2000 | Gano et al. |
| 6,065,209 | A | | 5/2000 | Gondouin |
| 6,065,543 | A | | 5/2000 | Gano et al. |
| 6,073,697 | A | | 6/2000 | Parlin et al. |
| 6,079,488 | A | | 6/2000 | Begg et al. |
| 6,079,494 | A | | 6/2000 | Longbottom et al. |
| 6,125,937 | A | | 10/2000 | Longbottom et al. |
| 6,138,761 | A | * | 10/2000 | Freeman et al. ..... 166/313 |
| 6,244,337 | B1 | | 6/2001 | Cumming et al. |
| 6,401,815 | B1 | * | 6/2002 | Surjaatmadja et al. ..... 166/277 |
| 6,575,243 | B2 | * | 6/2003 | Pabst ..... 166/250.08 |
| 2001/0025710 | A1 | * | 10/2001 | Ohmer et al. ..... 166/313 |
| 2002/0020533 | A1 | * | 2/2002 | Tubel ..... 166/313 |
| 2004/0035581 | A1 | * | 2/2004 | Cavender ..... 166/313 |

* cited by examiner

TESTING A JUNCTION OF PLURAL BORES IN A WELL

TECHNICAL FIELD

This invention relates generally to testing a junction of plural bores in a well, such as a junction between a main wellbore and a lateral bore of a multilateral well.

BACKGROUND

To produce hydrocarbons from a reservoir in an earth sub-surface, one or more wellbores are drilled into the earth sub-surface to intersect the reservoir. The wellbores are completed by installing casings or liners, packers, tubings or pipes, valves, and other components. Perforations are also formed at one or more zones in the wellbores, with hydrocarbons flowing through the perforations into the wellbores.

To enhance the productivity of a reservoir, multiple lateral bores are drilled from a main wellbore to increase the interface area between the reservoir and the well. Following the drilling of lateral bores from a main wellbore, the junction of the main wellbore and each lateral bore is completed with a junction assembly.

Typically, the junction assembly defines a sealed path from a lateral bore into the main wellbore to enable the flow of hydrocarbons from the reservoir into the lateral bore, through the junction assembly into the main wellbore, and up to the surface of the well.

One of the concerns associated with junction assemblies is that leaks may occur at the junction due to defective components. Usually, such leaks are not detected until after completion of the junctions of a well. For example, a well operator may detect leaks in the junction assemblies during well operation that prevent proper operation of the well. If that occurs, then the well operator will have to perform an expensive intervention operation to fix the faulty junction assembly. Intervention operations are typically time consuming and expensive. In addition to hauling heavy equipment to a well site, the well operator usually has to shut down the well. Well interventions are especially expensive in subsea applications, where it is difficult to move intervention equipment to a well site and to lower the intervention equipment into the subsea well.

SUMMARY

In general, methods and apparatus are provided to test a junction assembly during installation of the junction assembly. For example, a method of completing a well includes installing a junction assembly at a junction of first and second bores in a well, and during an installation procedure of the junction assembly, testing a sealed connection in the junction assembly. The method further includes determining, during the installation procedure, whether the sealed connection in the junction assembly is leaking based on the testing.

Other or alternative features will be apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "up" and "down"; "upper" and "lower"; "upwardly" and downwardly"; "upstream" and "downstream"; "above" and "below"; and other like terms indicating relative positions above or below a given point or element are used in this description to more clearly describe some embodiments of the invention. However, when applied to equipment and methods for use in environments that are deviated or horizontal, such terms may refer to a left to right, right to left, or other relationship as appropriate.

Figure 1:
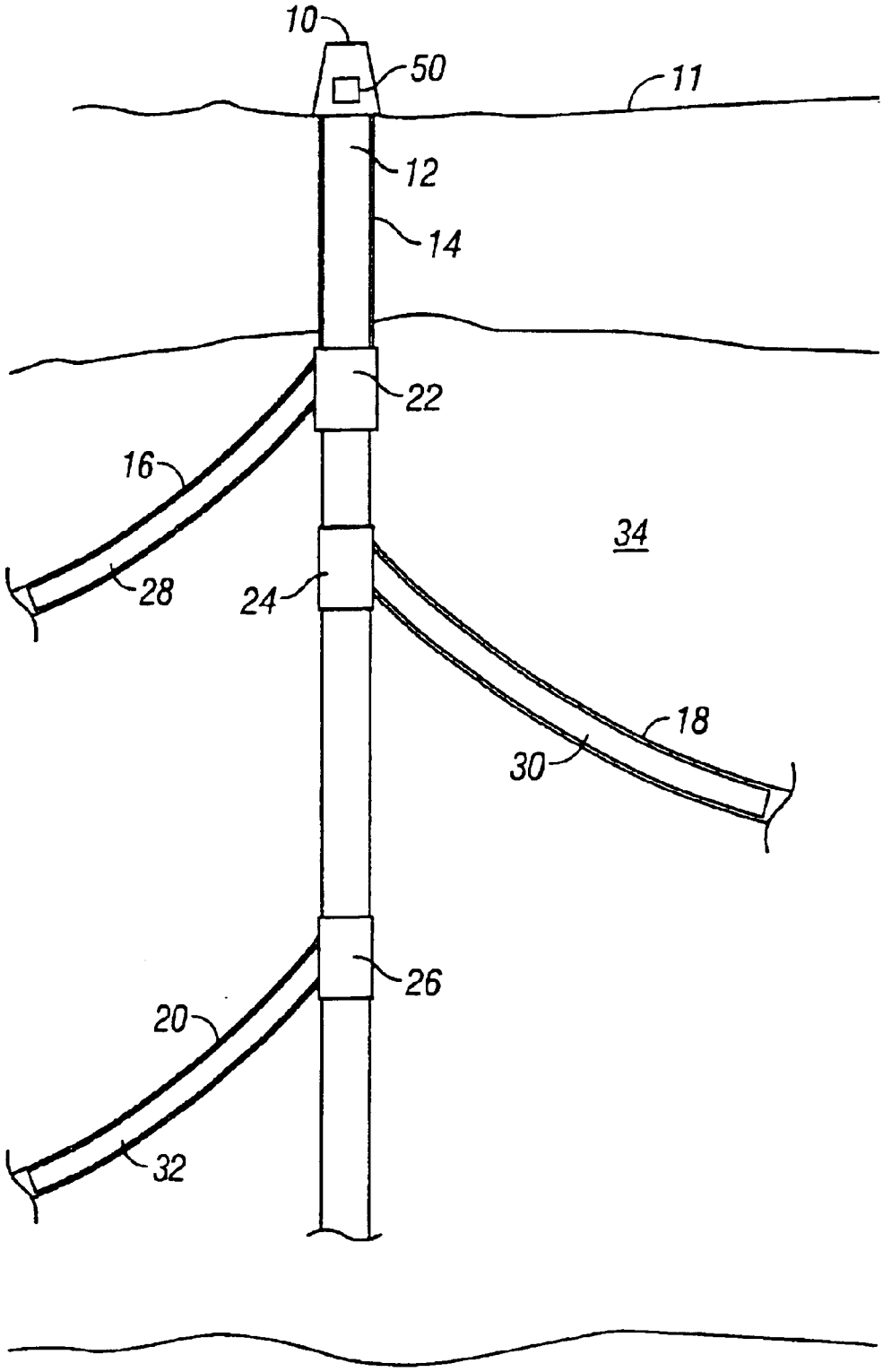
FIG. 1 illustrates an example multilateral well having multiple lateral bores along with junction assemblies to complete respective junctions.

Referring to FIG. 1, a well includes wellhead equipment 10 at the earth surface 11, and a wellbore 12 extending from the wellhead equipment 10. A portion of the wellbore 12 is lined by casing 14. The well illustrated in FIG. 1 is a multilateral well that includes multiple lateral bores 16, 18 and 20 drilled from the wellbore 12 (referred to as the main bore). Although shown with three lateral bores 16, 18 and 20, other embodiments can include a smaller or larger number of lateral bores. At each junction between the main wellbore 12 and a lateral bore, a junction assembly is provided. As shown in FIG. 1, three junction assemblies 22, 24, and 26 are provided at respective junctions. The lateral bores 16, 18, and 20 include fluid conduits 28, 30, and 32, respectively. The lateral bores 16, 18, and 20 receive hydrocarbons from a surrounding reservoir 34. Depending on settings of various valves in the completion equipment in the well, hydrocarbons from the reservoir 34 flow into one or more of the fluid conduits 28, 30, and 32 of the lateral bores 16, 18, and 20, respectively. The fluid is flowed through one or more of the junction assemblies 22, 24, and 26, through the wellbore, and up to the well surface.

FIG. 1 illustrates the multilateral well in its completed state. To form the multilateral well, the main wellbore 12 and the lateral bores 16, 18, and 20 are drilled. Following formation of the lateral bores 16, 18, and 20, appropriate casing and liners are installed in the well. In addition, the junction assemblies 22, 24, and 26 are also installed.

The junction assemblies 22, 24, and 26 can be installed in one trip, or in multiple trips. The process of installing junction assemblies is referred to as an "installation procedure" of the junction assembly. The installation procedure involves running in of the junction assembly equipment on a work string or running string into the well. Each junction assembly may be installed in multiple runs, such as by first installing a template followed by the installation of a connector through the template into a lateral bore. In other embodiments, the installation of each junction assembly may involve only one run instead of multiple runs.

A desired characteristic of each junction assembly is that it has one or more sealed connections to enable fluid to flow from the lateral bore into the main wellbore without leaking into other parts of the well. A "sealed connection" of the junction assembly refers to any connection or interaction between components of the junction assembly or between the junction assembly and another component. It is desired to identify any problems at each junction assembly as early in the well completion process as possible. Waiting until after the well completion has been installed to determine whether a junction assembly is leaking may cause the subsequent repair or replacement of the faulty junction assembly to be time consuming and thus expensive. Therefore, in accordance with some embodiments of the invention, each junction assembly is tested during the installation procedure of the junction assembly. By testing each junction assembly during its installation, faulty junction assemblies can be detected early (that is, during installation). If the junction assembly is detected to be faulty, it can then be removed and replaced with another junction assembly. This avoids the necessity of an intervention run into the wellbore to fix a faulty junction assembly.

Figure 2:
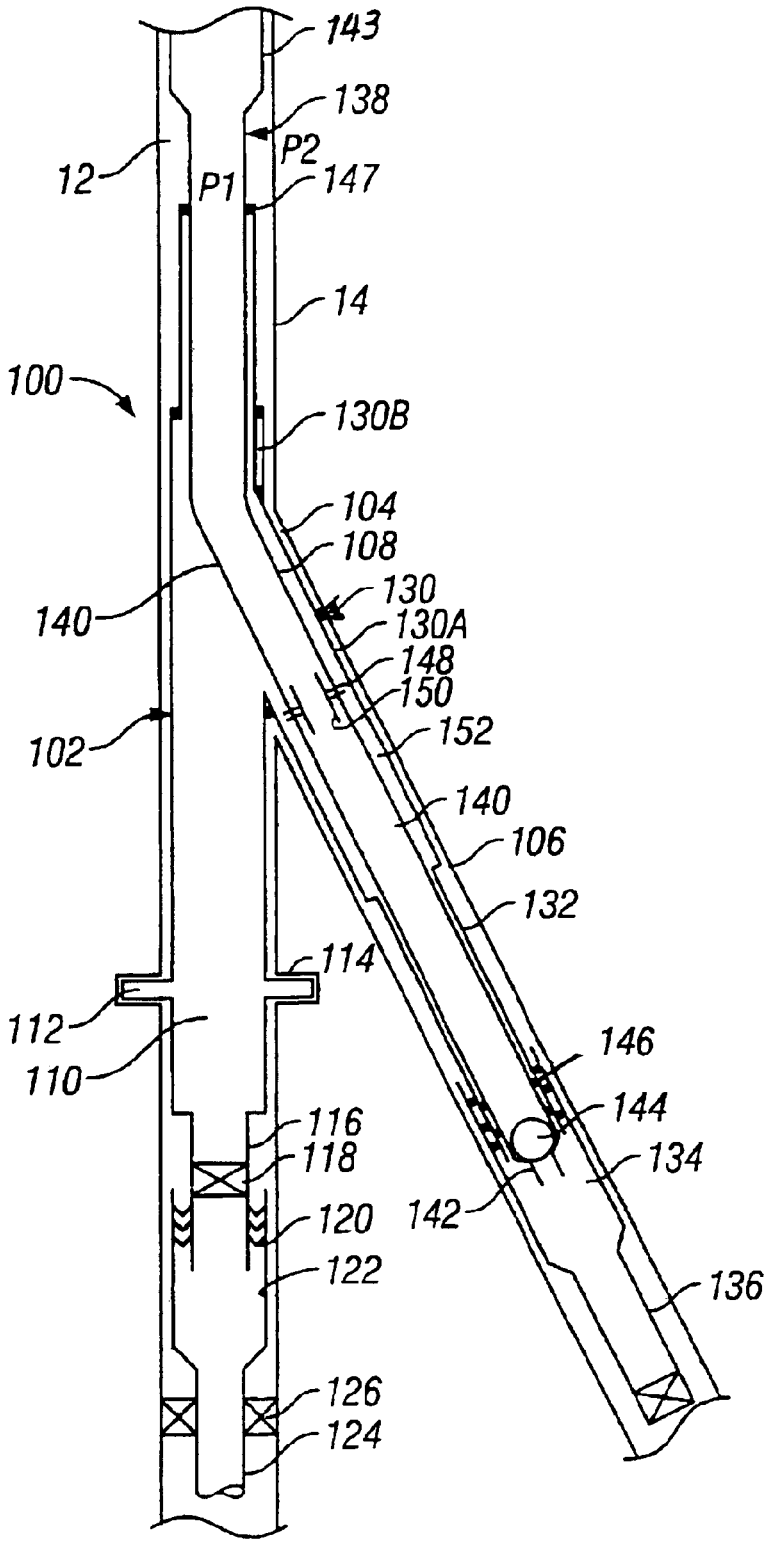
FIG. 2 is a longitudinal sectional view of a junction assembly according to one embodiment that enables testing of a sealed connection in the junction assembly.

FIG. 2 illustrates one embodiment of a junction assembly 100 containing a structure that enables testing of the junction assembly 100. The junction assembly includes a template 102 that is installed inside the casing 14. A window 104 is formed in the casing 14 that opens into a lateral bore 106 that extends from the main wellbore 12. The template 102 also has a window 108 that coincides with the window 104 in the casing 14 when the template 102 is landed at the junction.

As illustrated, a lower portion of the template 102 includes a landing tool 110 that has a profile 112 to mate with a corresponding profile 114 in the casing 14. Although not shown, the landing tool 110 and the landing profiles 112 and 114 are associated with an orienting mechanism to provide a desired azimuthal orientation of the template 102 with respect to the window 104 in the casing 14. The orienting mechanism orients the template 102 such that the window 108 of the template 102 is azimuthally aligned with the window 104 in the casing 14.

A pipe 116 extends from the lower end of the template 102. A plug 118 is provided in the pipe 116 to block fluid flow through the pipe 116. Effectively, the plug 118 blocks fluid flow between the inner bore of the template 102 and the region of the well below the template 102. The plug 118 is a retrievable plug that can be removed from inside the pipe 116 during well operation to enable fluid flow between the inside of the template 102 and the region of the wellbore below the junction assembly 100.

In alternative embodiments, instead of a plug 118, a valve can be used that can be actuated between open and closed positions. For example, the valve can be a formation isolation valve or other type of valve.

A seal 120 is arranged outside the pipe 116 to enable the pipe 116 to be sealably stabbed into a seal bore 122. Another pipe 124 extends below the seal bore 122. A packer 126 is provided around a portion of the pipe 124 to isolate the regions above and below the packer 126. The seal bore 122, packer 126, and pipe 124 are installed in the wellbore before the installation of the template 102.

The template 102 is configured to receive a connector 130 having a portion 130A that extends through the window 108 of the template 102. The connector portion 130A protrudes into the lateral bore 106. Another portion of the connector 130 is portion 130B that is in the main wellbore 12. The connector 130 is sealably connected to the template 102 such that fluids and solids are blocked from being communicated between the inside fluid path of the junction assembly 100 and the outside of the junction assembly 100.

A pipe section 132 extends from a distal end of the connector 130 inside the lateral bore 106. The pipe section 132 is sealably engaged inside a seal bore 134, with another pipe 136 extending below the seal bore 134.

For purposes of testing the seal integrity of the junction assembly, a test tool 138 is run into and through the connector 130. The test tool 138 has a conduit 140 that extends through the connector 130 and into the pipe section 132. The lower end of the test tool 138 includes a ball seat 142 to receive a ball 144 that is dropped into the test tool 138 from the well surface for testing the junction assembly 100. A running string 143 is attached to the upper end of the test tool 138. The running string 143 lowers the test tool 138 into the junction assembly 100.

The upper portion of the connector 130 sealably receives the test tool 138 by providing a seal 147 at the inner surface of the connector 130 to engage an outer surface of the test tool 138. The lower end of the test tool 138 is sealably engaged inside the pipe 132 by providing a seal 146 between an outer surface of the connector test tool 138 and an inner surface of the pipe 132.

Instead of the arrangement that includes the ball 144 and ball seat 142 for shutting in the distal portion of the test tool 138, other types of mechanisms are used in other embodiments for shutting in the distal portion of the test tool 138.

Radial circulation ports 148 are also provided somewhere along the length of the test tool 138. Flow through the circulation ports are controlled by a sleeve valve 150, which can be actuated to move so that the radial ports 148 are exposed to enable communication of fluid between the inner bore of the test tool conduit 140 and an annular region 152 between the test tool 138 and the connector 130.

In one embodiment, the sleeve valve 150 is responsive to an elevated pressure. For example, the sleeve valve is attached by a shear mechanism (not shown) to the test tool 138. Once the pressure inside the test tool 138 is raised to a sufficient pressure level, the shear mechanism is broken to enable the elevated pressure to act on the sleeve valve 150 to open the sleeve valve 150 so that flow can occur between the inner bore of the test tool conduit 140 and the annular region 152 through the circulation ports 148. In other embodiments, other mechanisms are used for opening the sleeve valve 150. Such other mechanisms include mechanisms that are electrically operated, actuated by mechanical force, and so forth.

Instead of a sleeve valve 150, other types of valves are used in other embodiments. For example, such other types of valves include flapper valves, ball valves, or other types of valves.

Figure 3:
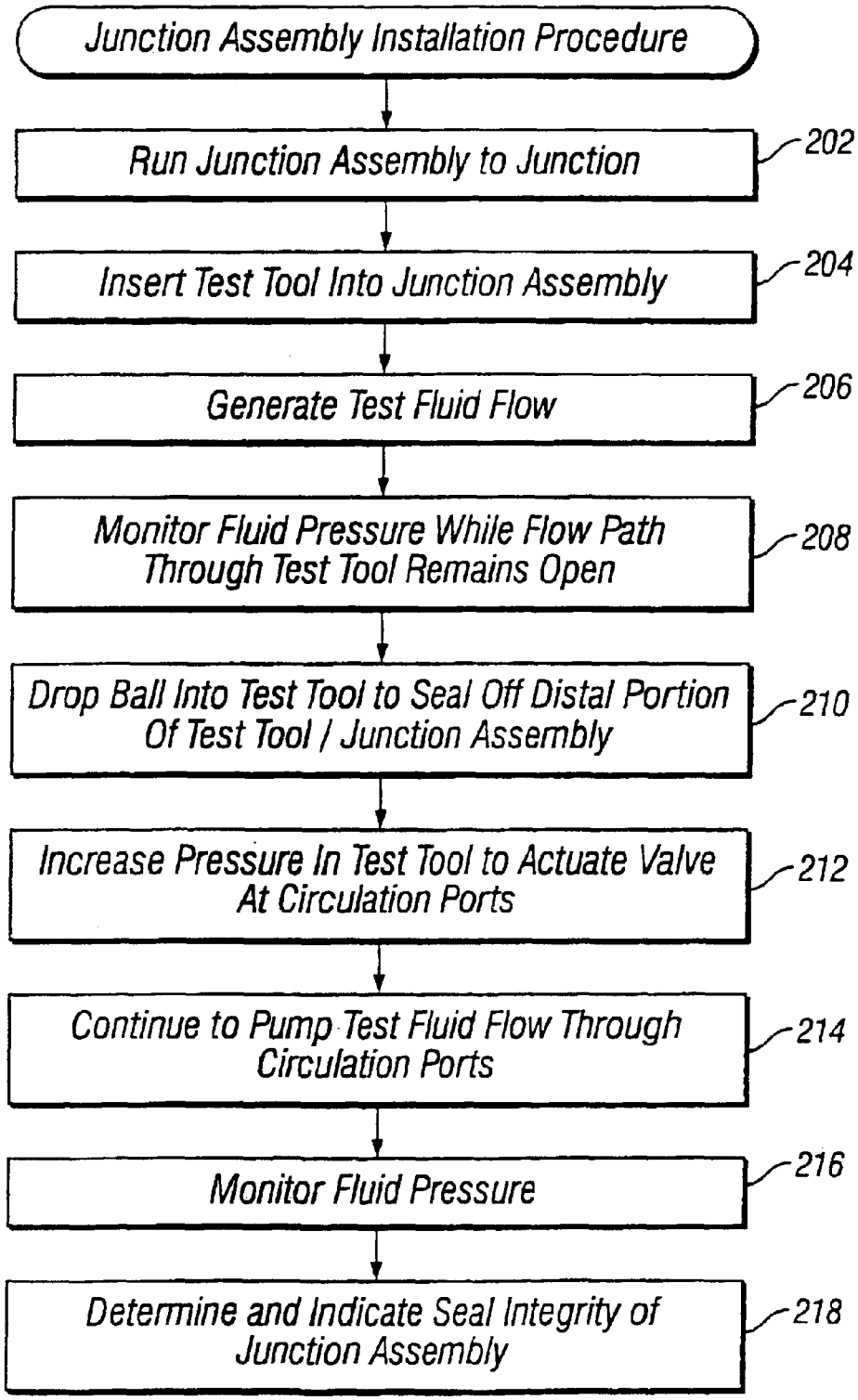
FIG. 3 is a flow diagram of a process of testing the sealed connection in the junction assembly, according to one embodiment.

FIG. 3 shows a junction assembly installation procedure according to one embodiment. First, the junction assembly 100 is run (at 202) to the junction. The test tool 138 is then run to the junction and inserted (at 204) into the junction assembly. A test flow of fluid is generated (at 206) through the test tool 138. The test flow of fluid can be generated at some time before the test tool 138 is inserted into the junction assembly 100, or after the test tool 138 has been inserted into the junction assembly 100. At this point, the ball 144 has not been dropped into the test tool 138, so that there is no blockage of the test fluid flow through the test tool conduit 140. The pressure is monitored (at 208) and recorded by monitoring equipment 50 (FIG. 1). In the illustrated embodiment, the monitoring equipment 50 is located at the surface of the well. Alternatively, the monitoring equipment 50 is located somewhere in the well. The monitoring equipment 50 is electrically connected to sensors (not shown) for measuring the pressure. The monitored pressure, referred to as P1, is the base pressure in the absence of impedance to the test fluid flow through the test tool conduit 140.

Next, the ball 144 is dropped (at 210) into the test tool 38. Once the ball 144 is seated on the ball seat 142, flow through the test tool conduit 140 is blocked, which causes the pressure within the test tool conduit 140 to increase (at 212). Upon the pressure increasing to a predetermined level, the sleeve valve 150 is actuated to the open position so that the circulation ports 148 are exposed to enable fluid inside the test tool conduit 140 to flow into the annulus region 152 between the test tool 138 and the connector 130. Pumping of the test fluid is continued (at 214) so that fluid is flowed through the circulation ports 148. At this point, the well operator monitors (at 216) the pressure level, referred to as P2. Because of the blockage of the test tool conduit 140 by the ball 144 at the distal portion of the test tool 138, the pressure within the test tool conduit 140 increases to a level (referred to as P2) that is higher than the pressure P1 without the blockage provided by the ball 144. The seal integrity of the junction assembly is determined (at 218) by the monitoring system 50. An indication of the seal integrity may also be provided.

Figure 4A:
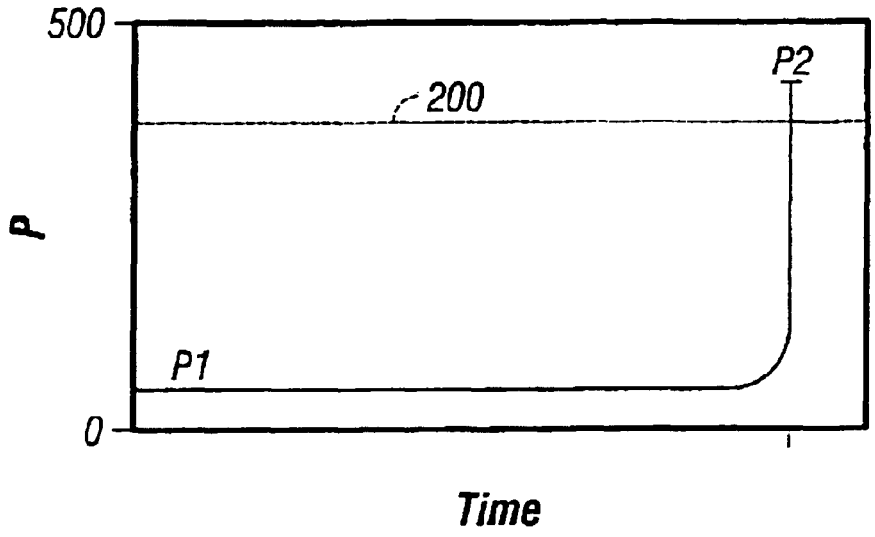
FIGS. 4A–4B are graphs illustrating pressure in a junction assembly as a function of time.
Figure 4B:
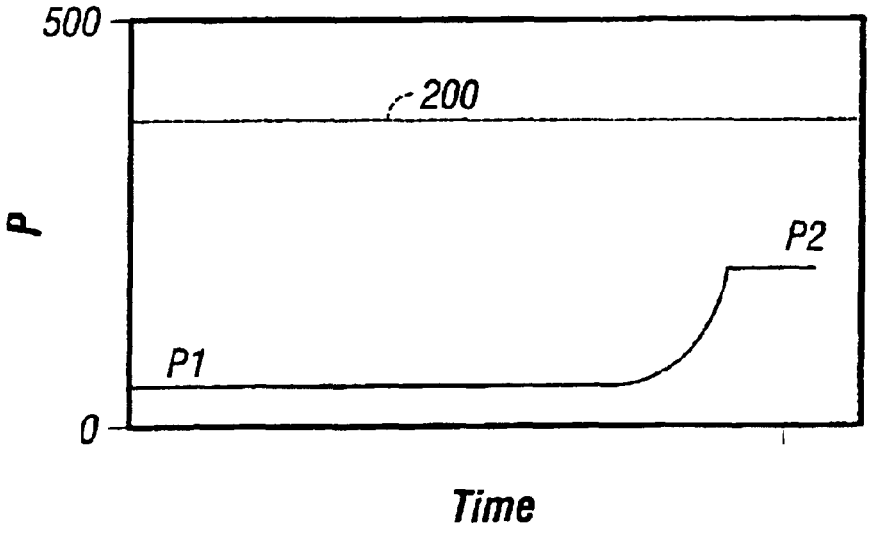

The extent of the pressure increase depends upon whether there is seal integrity in the junction assembly 100. If the seal integrity of the junction assembly 100 is "good" (that is, there is no substantial leakage at the one or more sealed connections of the junction assembly 100), then the pressure P2 increases to a relatively high level that is greater than a predetermined threshold 200, as shown in FIG. 4A. However, if the seal integrity of the junction assembly 100 is not good (that is, there is substantial leakage at the sealed connections of the junction assembly), then the pressure P2 increases to a level that is below the predetermined threshold, as shown in FIG. 4B. FIGS. 4A and 4B each depicts the pressure as a function of time.

Initially, after a test flow has been generated in the test tool 138 and before the ball 144 has been dropped, the pressure inside the test tool conduit 140 is at P1. Once the ball 144 is seated in the ball seat 142, the pressure inside the test tool increases. If the seal connections of the junction assembly 100 are working properly, then the pressure increases to a P2 level that is greater than the predetermined threshold 200. However, if the junction assembly is leaky, then the pressure P2 increases to a level that is below the predetermined threshold 200 (FIG. 4B).

A benefit of the procedure discussed in connection with FIG. 3 is that a faulty junction assembly can be identified during installation of the junction assembly. If the junction assembly is determined to be faulty, then the appropriate equipment can be run into the well to remove the junction assembly and replace it with another junction assembly.

The following FIGS. 5A–5D describe one example embodiment of the template 102 and connector 130 in further detail. Note that other junction assemblies can be used in other embodiments.

Figure 5A:
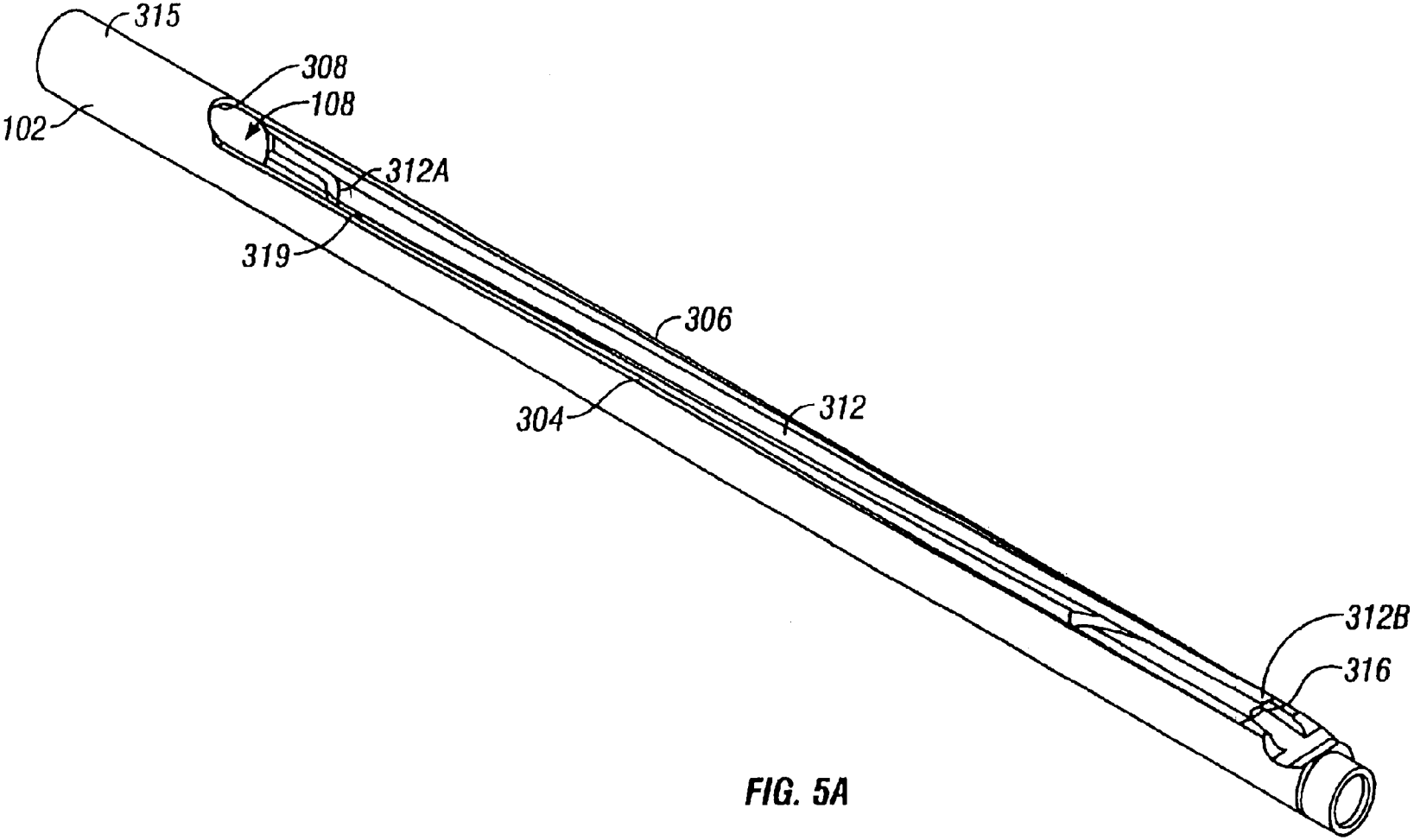
FIGS. 5A–5D illustrate a portion of a junction assembly according to one embodiment.
Figure 5B:
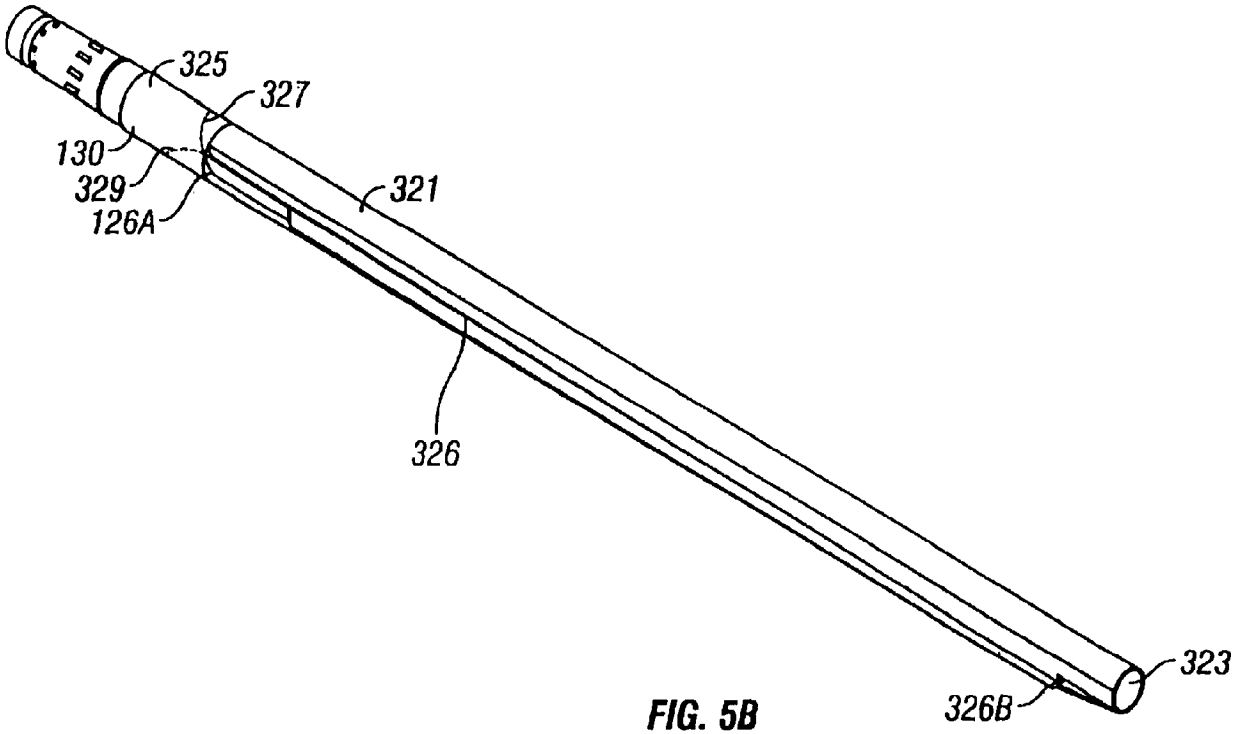
Figure 5C:
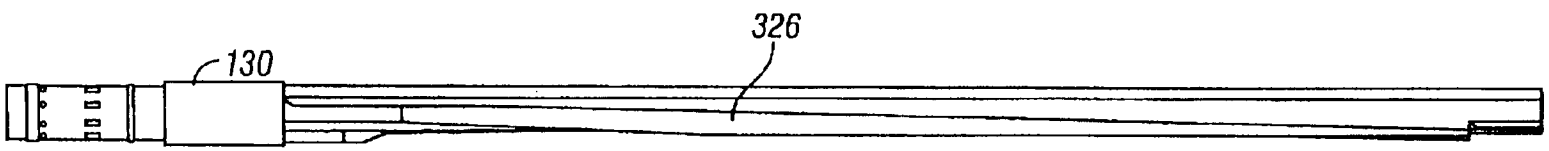
Figure 5D:
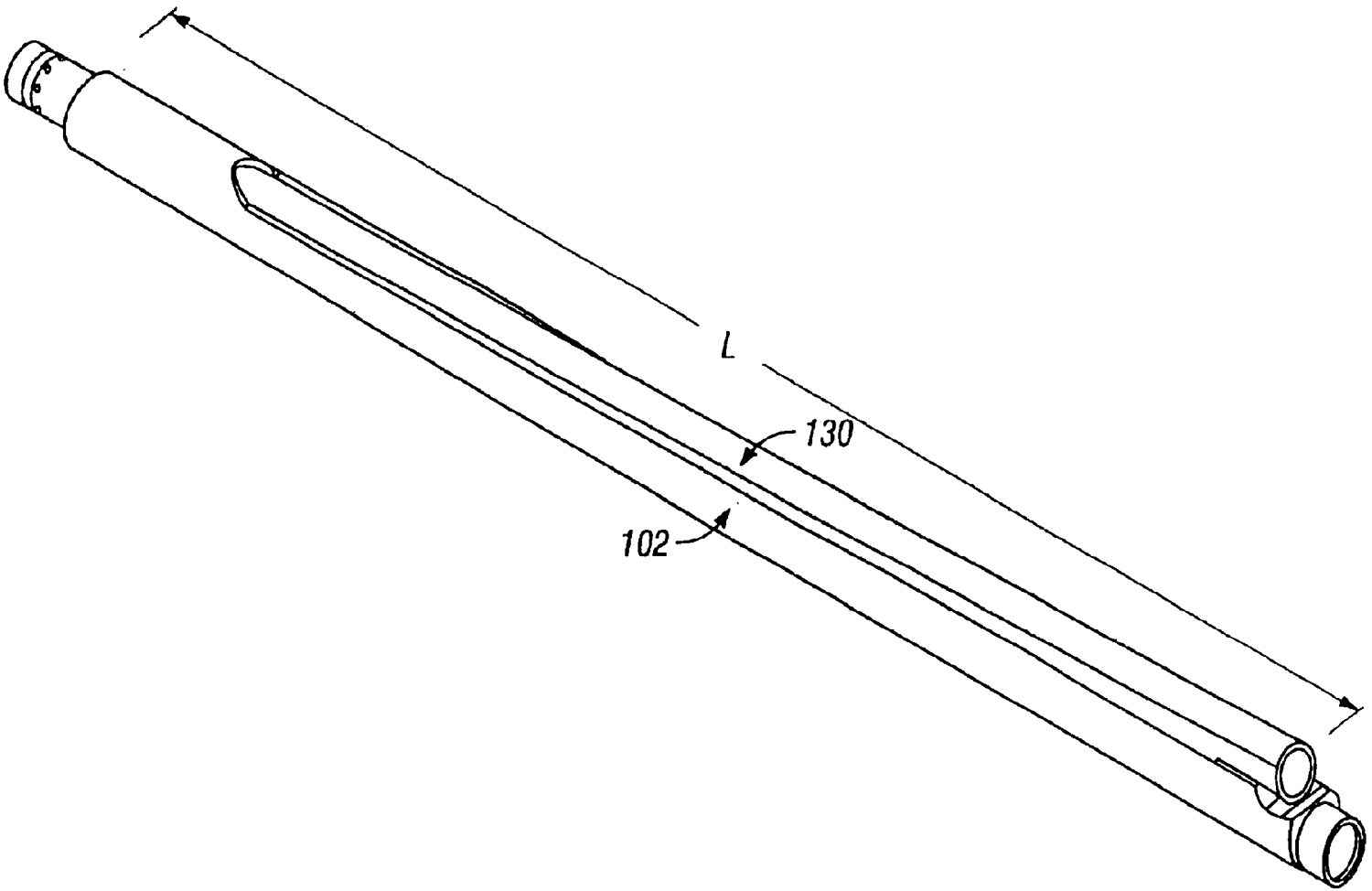

As shown in FIG. 5D, the template 102 and the connector 130 are engaged with each other along a length indicated generally as "L." A continuous interlocking mechanism is provided between the template 102 and the connector 130. The continuous interlocking mechanism provides improved interlocking characteristics as well as sealing characteristics. As used here, a "continuous interlocking mechanism" according to one embodiment is one that continuously extends along the length of engagement (L) of the connector 130 and the template 102, without any breaks or gaps in the inter-engagement members along the lengths of the inter-engagement members. Generally, the inter-engagement members in some embodiments extend from one end (e.g., upper end) of the template lateral window 108 to the other end (e.g., lower end) of the template lateral window. However, in an alternative embodiment, one or both of the inter-engagement members may be formed with one or more gaps or breaks (discussed further below).

In FIG. 5A, the inter-engagement members of the template 102 include a pair of continuous grooves 312 (only one of the grooves is visible in FIG. 5A) formed on the inner wall of the template 102. The continuous grooves 312 are adapted for engagement with a corresponding pair of continuous tongues or rails 326 (only one of the rails 326 is visible in FIGS. 5B–5C) formed on the external surface of the connector 130, as shown in FIGS. 5B–5C. In another arrangement, the grooves 312 are formed in the connector 130 and the rails are formed on the template 102. In yet further embodiments, other types of inter-engagement members can be employed on the connector 130 and template 102.

As further shown in FIG. 5A, the lateral window 108 formed through the template 102 is defined by generally parallel side surfaces 304 and 306. The side surfaces 304 and 306 are joined at the upper end by a curved end surface 308. As the lateral branch connector 130 is moved downwardly, an angulated ramp surface of the template 102, in conjunction with the cooperation of the continuous grooves 312 and continuous rails 326, directs the lower end portion of the connector 130 through the template window 108.

Each continuous groove 312 has an upper end 312A (the "proximal end") and a lower end 312B (the "distal end"). In the embodiment shown, the width of the groove 312 near the upper end 312A is larger than the width of the groove 312 near the lower end 312B. The width of the groove 312 gradually decreases along its length, starting at the upper end 312A, so that the groove has a maximum width at the upper end 312A and a minimum width at the lower end 312B. In other embodiments, other arrangements of the continuous grooves 312 are possible. For example, each continuous groove can have a generally constant width along its length. Alternatively, instead of a gradual variation of the groove width, step changes of the groove can be provided.

The enlarged upper portion of each groove 312 provides an orientation mechanism for guiding a corresponding rail 326 of the connector 130 into the groove 312. The upper portion of the groove 312 has at least one angulated surface 319 for guiding the connector rail 326.

The lower end 312B of each groove 312 in the template 102 defines a lower connector stop 316, which is engageable by the lower end of the connector rail 326 to prevent further downward movement of the connector 130 once the connector rails 326 are fully engaged in the grooves 312.

Referring to FIGS. 5B–5C, the continuous rails 326 of the connector 130 extend from the outer surface on opposite sides of the connector housing 321 (only one of the rails 326 is visible in FIGS. 5B–5C). The connector housing 321 defines a bore 323 extending therethrough to enable the flow of fluids (production or injection fluids). As shown in FIGS. 5B–5C, the continuous rails 326 extend substantially along the length of engagement (L in FIG. 5D) between the connector 130 and the template 102. The continuous rails 326 are arranged and oriented for engagement with the continuous grooves 312 of the template 102. As the connector 130 is moved downwardly within the lateral branch template 102, the inter-engagement members 312 and 326 are moved into interlocking relation with each other.

Each continuous rail 326 has an upper end 326A (the "proximal end") and a lower end 326B (the "distal end"). The width of the upper end 326A is larger than the width of the lower end 326B. The rail 326 gradually decreases in width along its length starting from the upper end 326A. In other embodiments, other arrangements of the rails 326 are possible. The variation of the width of the rails 326 is selected to correspond generally to the variation of the width of the grooves 312 in the template 102.

As further shown in FIGS. 5B–5C, the continuous rails 326 incline generally downwardly. On the other hand, the continuous grooves 312 (FIG. 5A) incline generally upwardly. The inclined arrangements of the rails 326 and grooves 312 serve to guide the connector 130 outwardly through the window 108 formed through the template 102 (FIG. 5A) so that the distal portion of the connector is guided into the lateral bore (FIG. 2).

Also, as the connector 130 is forced to follow the inclined path provided by the inclined grooves 312 and rails 326, the connector 130 is elastically and/or plastically deformed to follow the inclined path. Thus, as bending force is applied to the connector housing 321 by the ramping action of the rail and groove interlocks, the connector housing 321 is deformed or flexed to permit its lower end to move through the casing window and into the lateral branch bore. FIG. 5D shows the connector 130 and template 102 in the engaged position.

The continuous rail and groove interlocking mechanism shown in FIGS. 5A–5D forms a lateral branch or junction assembly that has sufficient structural integrity to withstand the mechanical force induced during well operation. For example, the mechanical force may be applied by shifts occurring in the surrounding earth formation. Also, forces are induced by the flow of fluid through the junction. The continuous rail and groove interlocking mechanism also prevents solids (such as sand or other debris) from entering the production stream from the lateral branch and permits branch connector movement that establishes efficient sealing with the branch liner of the lateral branch bore.

In an alternative embodiment, instead of a continuous rail 326 as shown in FIG. 5B, the rail 326 can be separated into two or more segments, with gaps or breaks between segments.

Figure 6A:
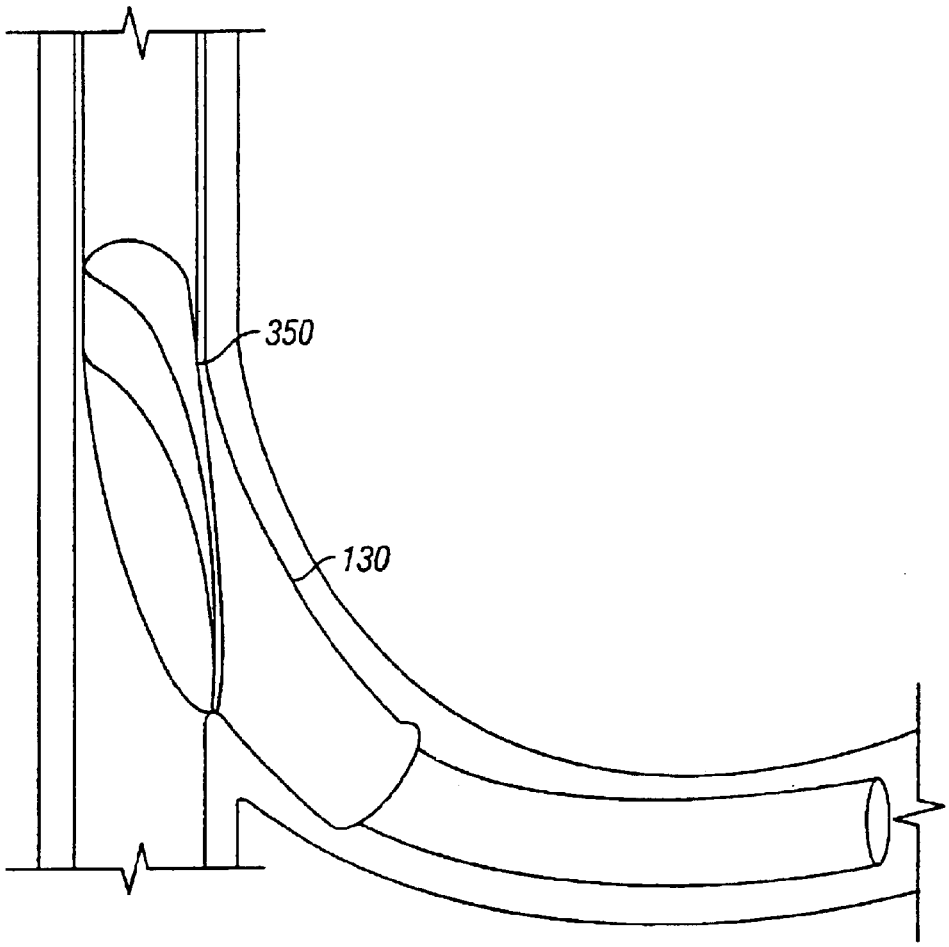
FIGS. 6A–6B illustrate embodiments of a seal used in the junction assembly of FIGS. 5A–5D.

Another desired feature of some embodiments of the invention is that a continuous fluid seal path is defined around the periphery of the lateral window 108 of the template 102. As schematically illustrated in FIG. 6A, the continuous fluid seal path is represented as a continuous, closed curve 350. The fluid seal path can be implemented with a sealing element, such as an elastomer seal. The sealing element is provided between an outer surface of the connector 130 and an inner surface of the template 102. The continuous fluid seal path 350 can be provided when used with either a continuous rail 326 (as shown in FIGS. 5B, 5C) or a segmented or discontinuous rail.

To provide the closed seal path, the sealing element in one embodiment is routed along the rails 326 (FIG. 5B) and runs along the upper portion 325 of the connector 130 either around the front side (indicated as 327 in FIG. 5B) of the upper portion 325 or around the rear side (indicated as 329) of the upper portion 325. A groove can be provided on the upper portion 325 to receive the sealing element.

At the lower end of the continuous seal path 350, the sealing element wraps around, or makes a "U-turn" around the lower end 326B of the rails 326. Thus, when the lower end 326B, and the sealing element wrapped around the lower end, engages the stop 316 (FIG. 1) of the template 102, a sealing engagement is formed between the lower end 326B and the stop 316. By employing the continuous (and closed) seal path 350, isolation around the template lateral window can be achieved.

Figure 6B:
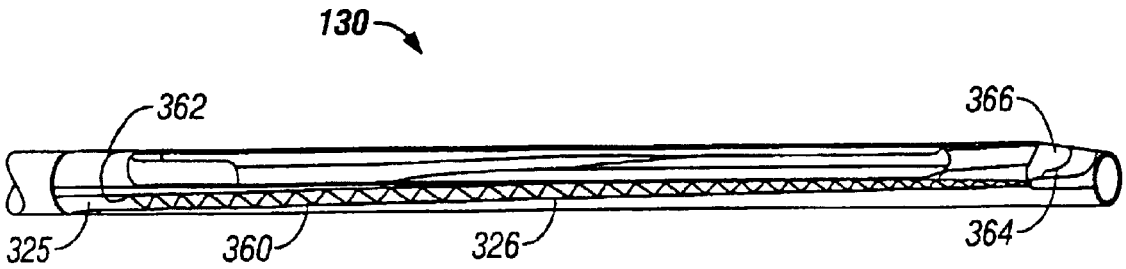

Referring to FIG. 6B, according to another embodiment, an upside down view of the connector 130 is illustrated. A sealing element 360 runs continuously along the rail 326 on the visible side. The sealing element 360 wraps around (indicated by 362) the upper portion 325 of the connector 130 to the other side of the connector 130, where the sealing element 360 runs on the other rail 326 (not shown). The sealing element 360 may run in a groove along the path 362 in the example. At the lower end of the connector 130, the sealing element 360 runs along a defined path 364 (in a groove, for example) to the other side of the connector 130. When engaged to corresponding surfaces of the template 102, a closed, continuous seal path is defined around the lateral window 108 of the template 102. In the embodiment shown in FIG. 6B, the surface 366 in which the sealing element 360 is routed over is generally inclined or curved. As a result, the gap at the seal portion 364 is gradually reduced as the inclined or curved surface 366 of the connector 130 mates with a corresponding inclined or curved surface (not shown) of the template 102. A sealing engagement is achieved once the connector 130 fully engages the template 102.

In the illustrated example, the sealing element 360 undulates along the rail 326 to form a generally wavy sealing element. The generally wavy form of the sealing element 360 enables a more secure engagement in a groove formed in the rail 326. Other shapes of the sealing element 360 may be used in other embodiments.

Figure 7:
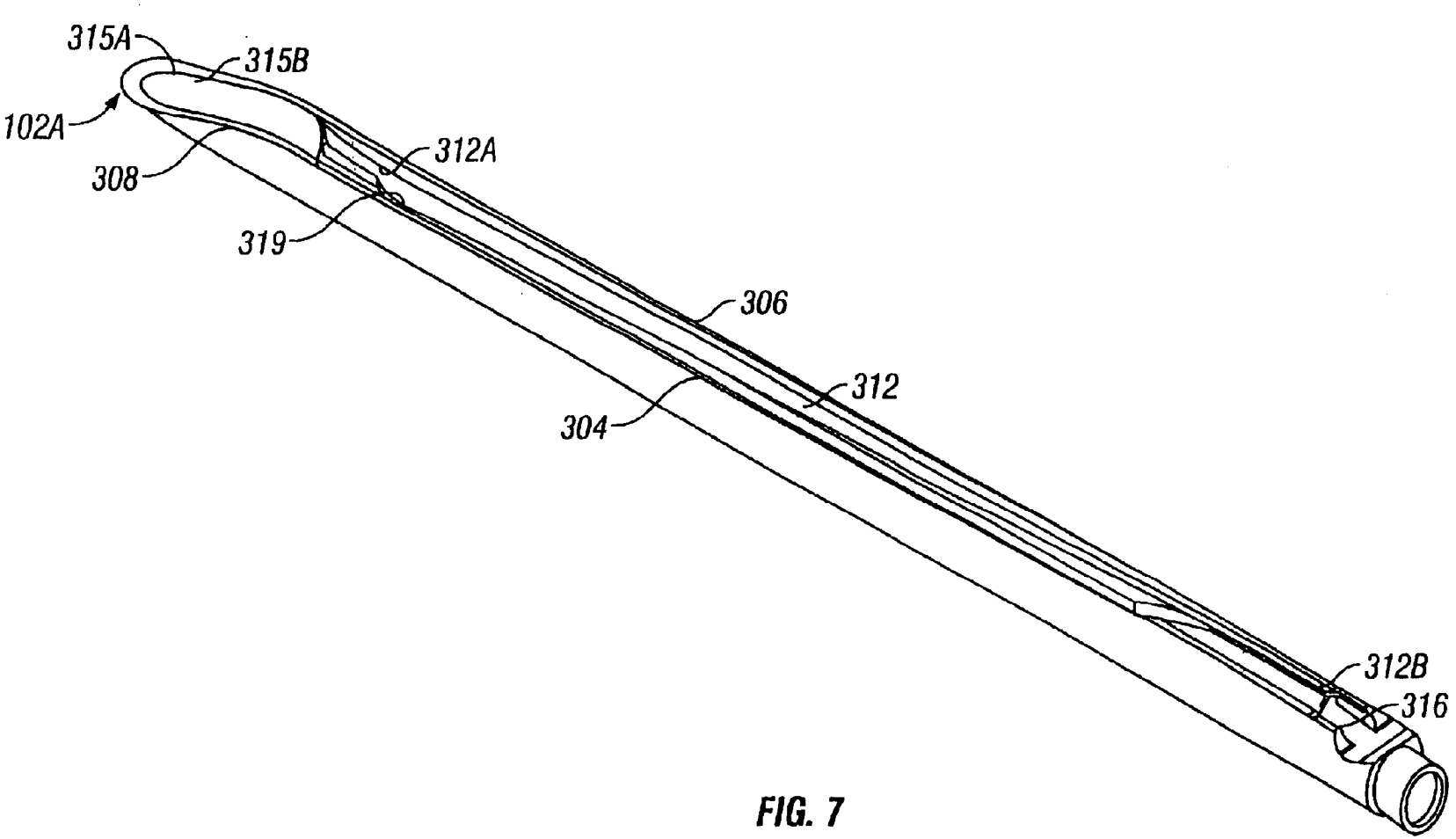
FIG. 7 illustrates another embodiment of a junction assembly.

In the template 102 shown in FIG. 5A, the upper portion 315 of the template 102 is a tubular housing that encloses an inner bore. However, in an alternative embodiment, as shown in FIG. 7, a template 102A has an upper portion 315A that has an open side 315B. By employing an upper portion that has one side open, a larger space is provided at the upper end of the junction assembly 100 when the connector 130 and template 102A are engaged.

Figure 8:
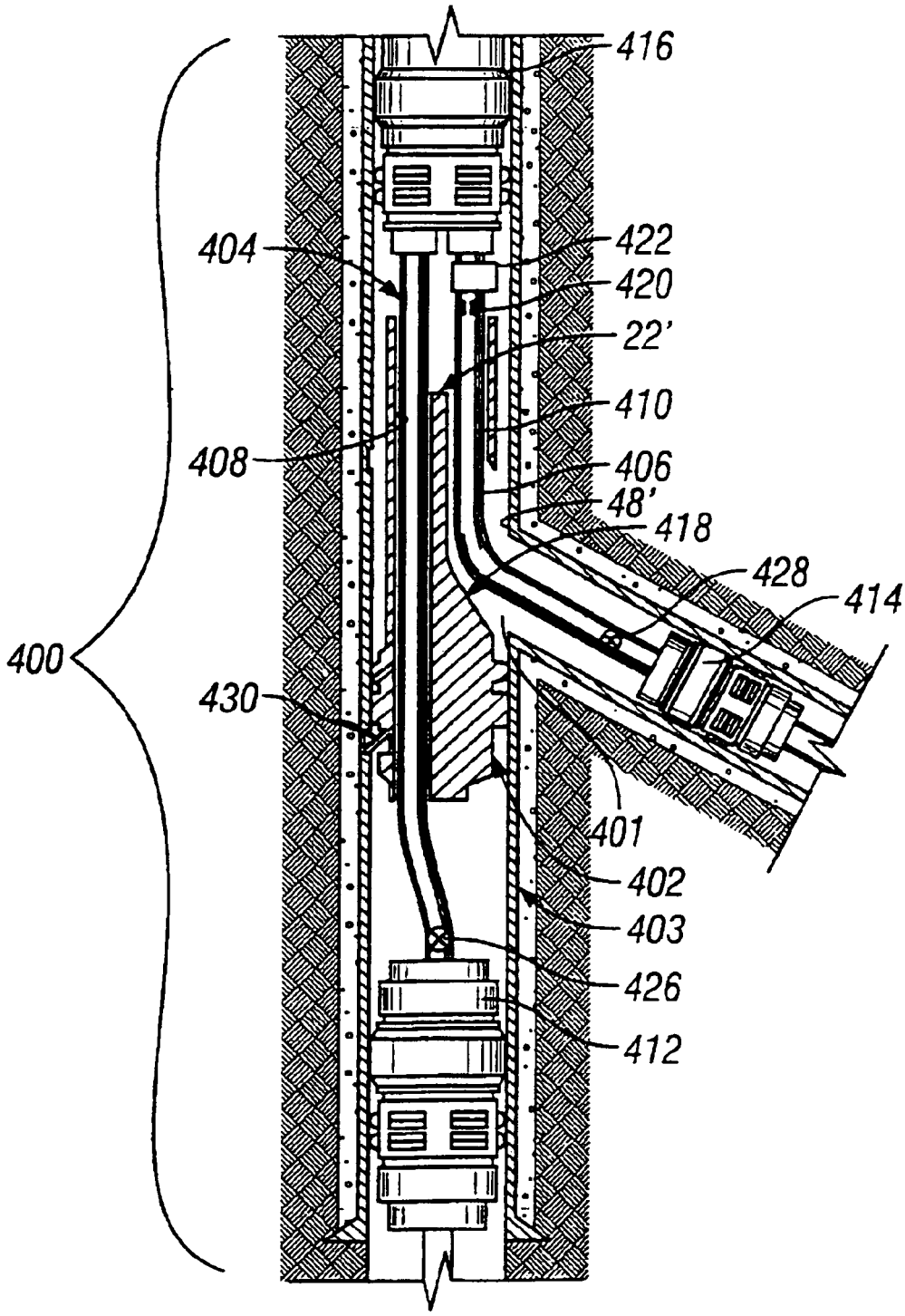
FIG. 8 illustrates a junction assembly according to another embodiment that enables testing of a sealed connection of the junction assembly.

Referring to FIG. 8, an alternative embodiment of a junction assembly 400 is illustrated. The junction assembly has a body member 402 that includes two paths 408 and 410 through which two tubings 404 and 406, respectively, are passed through. The lower end of the tubing 408 is connected to a packer 412, which is set in the main wellbore depicted in FIG. 8. The lower end of the tubing 410 is connected to another packer 414, which is set inside the lateral bore. In one embodiment, the packers 412 and 414 each have a polished bore receptacle for receiving the respective tubings 404 and 406. The upper ends of the tubings 404 and 406 are connected to a dual packer 416.

The body member 402 defines a diverter surface 418 for directing lateral branch equipment, including the packer 414 and a portion of the tubing 406 into the lateral bore.

One or more radial circulation ports 420 are defined near the upper end of the tubing 406. Flow through the circulation ports 420 is controlled by a sleeve valve 422 (or by some other type of valve). Also, plugs 426 and 428 are provided at the distal ends of tubings 404 and 406, respectively. Alternatively, the plug 426 can be a retrievable plug and is similar to the plug 118 shown in FIG. 2. The plug 428 can be a ball-type plug (where a ball is dropped from the surface to a ball seat at the lower end of the tubing 406). In yet other embodiments, other types of plugs can be used, including valves, and so forth.

In operation, the packers 412 and 414 are first set in the main wellbore and lateral bore respectively. Next, an assembly including the dual packer 416, body member 402, and tubings 404 and 406 are lowered into the main wellbore and run to the junction between the main wellbore and lateral bore. Initially, the tubings 404 and 406 are attached to the body member 402 such that the lower ends of the tubings 404 and 406 are above the diverter surface 418. As the assembly is being installed at the junction, an orienting member 430 is used to orient the body member 402 with respect to a casing 403 set in the main wellbore. The body member 402 is oriented such that the tubing 406 is aligned with respect to the lateral window 401. Once installed, a downward force is applied on the work string that is connected to the assembly to push the tubings 404 and 406 downwardly. The tubing 406 is diverted by the diverter surface 418 into the lateral bore. The ends of the tubings 404 and 406 are engaged into the packers 412 and 414, respectively, and thereby sealably engaged in respective seal bores of the packers 412 and 414

As part of the installation procedure, leaks in the junction assembly 400 can be tested for according to some embodiments. As with the embodiment of FIG. 2, a test flow of fluid is generated while the plug 428 is open, so that there is no obstacle to fluid flow. At this point, the plug 426 is closed. The pressure of the fluid flow through the tubing 406 is monitored—this establishes the P1 pressure.

The plug 428 is then closed, which causes the pressure in the tubing 406 to increase. Once the pressure reaches a predetermined level, the valve 422 is actuated to the open position to allow flow between the inside of the tubing 406 and the region outside the tubing 406. The pressure increase to some level P2 is monitored. If P2 is greater than a predefined threshold, then there is no substantial leakage at the junction assembly 400.

Figure 9:
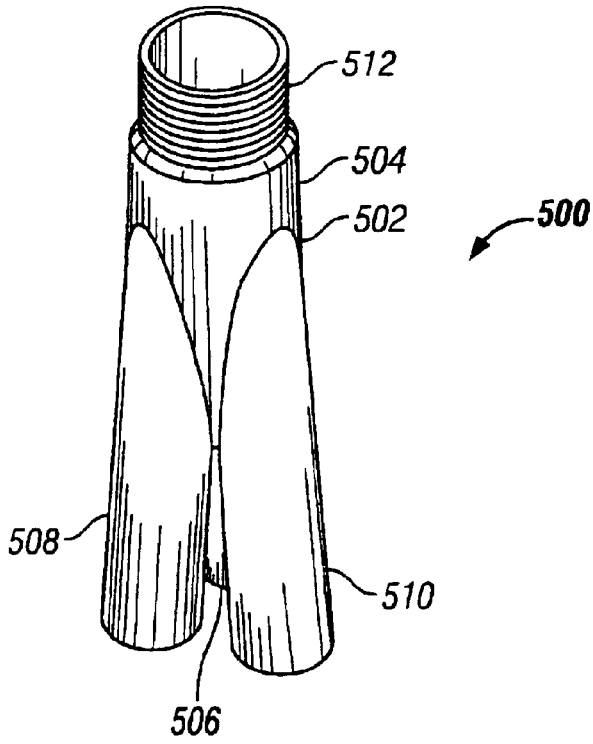
FIGS. 9, 10A–10D, and 11 illustrate a junction assembly according to yet a further embodiment that enables testing of a sealed connection of the junction assembly.

According to yet another arrangement, another type of junction assembly 500 (FIG. 9) can be used to complete a junction between a main wellbore and a lateral bore. This junction assembly includes a branching sub 502, which includes a branching chamber 504 and a plurality of branching outlets 506, 508, and 510. Threads 512 are provided at the upper end of the branching sub 502 to enable the branching sub 502 to be connected to equipment above the branching sub 502. The equipment to which the branching sub 502 can be connected includes a casing, as well as other types of tubings or pipes.

Figure 10A:
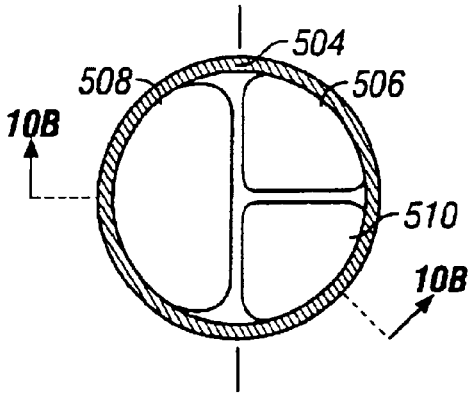
Figure 10B:
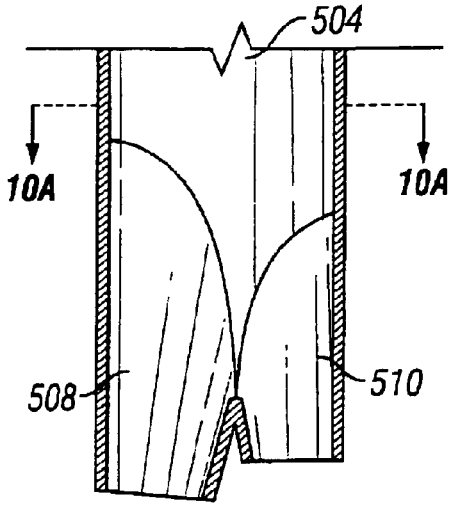

The branching sub 502 can be of any desired configuration. In one embodiment, as shown in FIGS. 10A–10B, the branching sub 502 is shown with three branching outlets 506, 508, and 510. Prior to insertion of the branching sub 502 into the well, the branching sub 502 and its branching outlets 504, 506, and 508 are deformed inwardly from generally round tubular shapes to deformed shapes as illustrated in FIGS. 10A–10B. The configuration of the deformed branching outlets 506, 508, and 510 substantially fill the circular area of a branching chamber 504. The branching outlets 506–510 can be deformed into a variety of shapes, for example, concave or convex, depending upon design considerations.

Figure 10C:
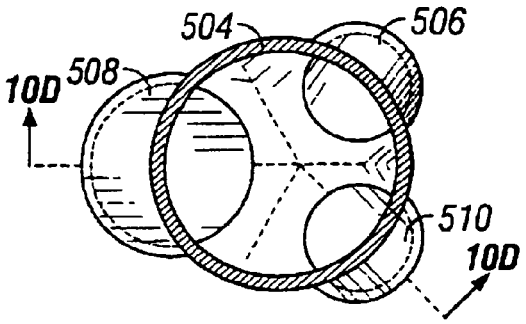
Figure 10D:
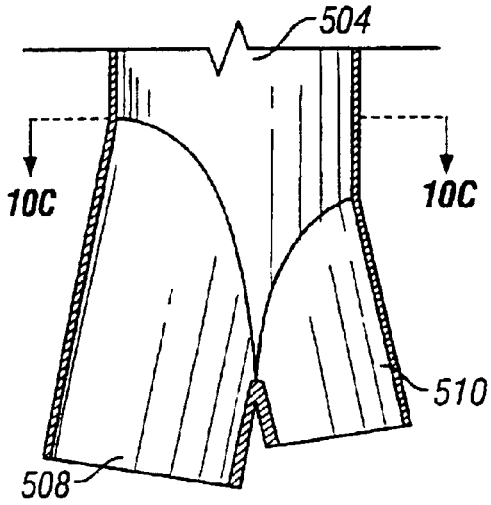

FIGS. 10C and 10D illustrate the branching sub 502 after it has been deployed downhole and after the branching outlets 506–510 are fully expanded. The branching outlets 506–510 are, in one embodiment, expandable to generally round tubular shapes. Expansion of the branching outlets 506–510 can be accomplished by use of a forming tool. Alternatively, fluid pressure can be applied to expand the branching outlets 506, 508, and 510.

Figure 11:
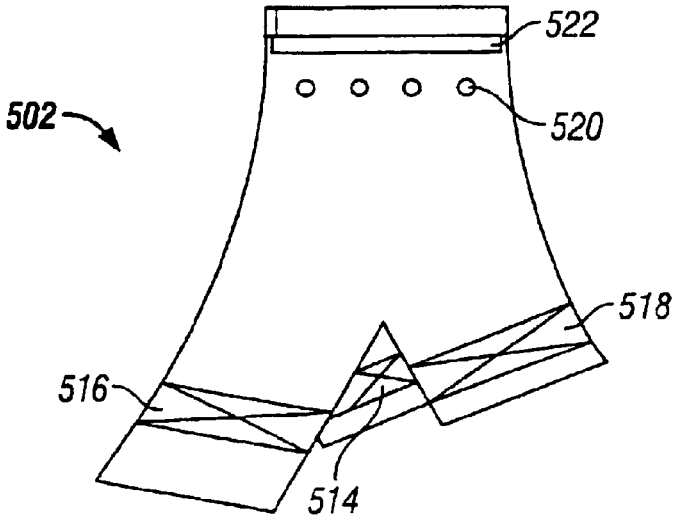

After the branching outlets have been expanded, closure members 514, 516, and 518 (FIG. 11) are installed at distal ends of each branching outlets 506, 508, and 510, respectively. Each of the closure members 514, 516, and 518 can be any one of the following: a plug, a valve, or any other flow control device that can be remotely actuated or actuated by some type of a shifting tool. As with the embodiments discussed above, at least before insertion of one of the closure members 514, 516 and 518, a flow of test fluid is generated through the work string and out of at least one of the branching outlets 506, 508, and 510. This test flow of fluid is associated with a pressure P1.

The branching sub 502 also has radial circulation ports 520 that are defined at the upper end of the branching sub 502. Flow through the circulation ports 520 are controlled by a valve 522, such as a sleeve valve.

To perform the test, all closure members 514, 516, and 518 are closed, which causes pressure to increase. The increasing pressure causes actuation of the valve 522 to open the circulation ports 520. This enables the flow of fluid from inside of the branching sub 502 to outside the branching sub 502. The increase in pressure in the junction is monitored to determine if there are any leaks.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A method of completing a well, comprising:

installing a junction assembly at a junction of first and second bores in a well;

during an installation procedure of the junction assembly, testing a sealed connection in the junction assembly;

determining, during the installation procedure, whether the sealed connection in the junction assembly is leaking based on the testing;

shutting off a distal portion of the junction assembly;

generating a test flow of fluid into the junction assembly during the testing;

monitoring a first pressure of the test flow of fluid in the junction assembly before the distal portion of the junction assembly is shut off; and monitoring a second pressure of the test flow of fluid after the distal portion of the junction assembly is shut off, wherein determining whether the sealed connection in the junction assembly is leaking is based on a level of increase between the second pressure and the first pressure.

2. The method of claim 1, further comprising:

actuating a valve to an open position in response to an increase in pressure in the junction assembly; and enabling fluid flow through at least one circulation port in response to the valve being actuated to the open position.

3. The method of claim 2, further comprising providing fluid flow from inside a test conduit through the at least one circulation port to an annular region outside the test conduit.

4. A method of completing a well, comprising:

installing a junction assembly at a junction of first and second bores in a well;

during an installation procedure of the junction assembly, testing a sealed connection in the junction assembly;

determining, during the installation procedure, whether the sealed connection in the junction assembly is leaking based on the testing;

shutting off a distal portion of the junction assembly; and generating a test flow of fluid into the junction assembly during the testing, wherein shutting off the distal portion of the junction assembly comprises dropping a ball from a well surface into the junction assembly.

5. A method of completing a well, comprising:

installing a junction assembly at a junction of first and second bores in a well;

during an installation procedure of the junction assembly, testing a sealed connection in the junction assembly;

determining, during the installation procedure, whether the sealed connection in the junction assembly is leaking based on the testing;

shutting off a distal portion of the junction assembly; and generating a test flow of fluid into the junction assembly during the testing, wherein the second bore comprises a lateral bore, and wherein shutting off the distal portion comprises shutting off a portion of the junction assembly in the lateral bore, wherein the first bore comprises a main bore, the method further comprising shutting off another portion of the junction assembly in the main bore.

6. An apparatus for use at a junction in a well, comprising:

a junction assembly having a fluid conduit to receive a test fluid flow;

a flow control element adapted to control flow through the fluid conduit, the flow control element when closed causing pressure of the test fluid flow to increase;

a circulation port adapted to be opened in response to the test fluid flow pressure reaching a predetermined level; and a device adapted to measure a first pressure of the test fluid flow before the flow control element is closed and to measure a second pressure of the test fluid flow after the flow control element is closed, wherein the device is adapted to determine if the junction assembly is faulty based on an amount of the second pressure over the first pressure.

7. The apparatus of claim 6, further comprising a valve to control flow through the circulation port, the valve actuatable by the test fluid flow reaching the predetermined level.

8. An apparatus for use at a junction in a well, comprising;

a junction assembly having a fluid conduit to receive a test fluid flow;

a flow control element adapted to control flow through the fluid conduit, the flow control element when closed causing pressure of the test fluid flow to increase; and a circulation port adapted to be opened in response to the test fluid flow pressure reaching a predetermined level, wherein the junction assembly has a template and a connector engageable in the template, the fluid conduit being extended through at least part of the template and connector.

9. The apparatus of claim 8, wherein the template is sealably engaged to the connector.

10. The apparatus of claim 8, wherein the template has a window, the connector adapted to extend through the window of the template when the connector is engaged in the template.

11. The apparatus of claim 10, further comprising a test tool containing the fluid conduit, the test tool extending through at least a part of the junction assembly.

12. The apparatus of claim 11, wherein the circulation port is adapted to provide fluid flow between the fluid conduit in the test tool and an annular region outside the test tool.

13. A system for use with a well, comprising:

a junction assembly;

a test conduit to receive a test flow of fluid, the test conduit extending at least in part of the junction assembly;

a fluid control device to control the test fluid flow through the test conduit, the fluid control device to create a pressure increase in the test conduit in response to the fluid control device closing; and a device to monitor the pressure increase and to determine if the assembly is leaky based on an amount of the pressure increase.

14. The system of claim 13, further comprising one or more circulation ports on the test conduit and at least one valve to control flow of the test fluid through the one or more circulation ports.

15. A system for use with a well, comprising:

a junction assembly;

a test conduit to receive a test flow of fluid, the test conduit extending at least in part of the junction assembly; and a fluid control device to control the test fluid flow through the test conduit, the fluid control device to create a pressure increase in the test conduit in response to the fluid control device closing, wherein the junction assembly has multiple outlets to communicate with multiple bores of the well, wherein one of the bores is a lateral bore, and wherein the junction assembly has a template and a connector, the connector to extend through a window of the template into the lateral bore.

16. The system of claim 15, wherein the connector is sealingly engaged in the template.

* * * * *